US007891220B2

(12) United States Patent
Yen et al.

(10) Patent No.: US 7,891,220 B2
(45) Date of Patent: Feb. 22, 2011

(54) MULTI-PURPOSE DETACHABLE LOCK CONTAINER AND METHOD OF USE

(75) Inventors: An-Ting Yen, Chien-Ho (TW); Chi-Chang Tsai, Chien-Ho (TW)

(73) Assignee: Sinox Company Ltd. (TW)

( * ) Notice: Subject to any disclaimer, the term of this patent is extended or adjusted under 35 U.S.C. 154(b) by 0 days.

(21) Appl. No.: 12/414,345

(22) Filed: Mar. 30, 2009

(65) Prior Publication Data

US 2009/0183537 A1 Jul. 23, 2009

Related U.S. Application Data

(63) Continuation of application No. 11/620,368, filed on Jan. 5, 2007, now abandoned.

(30) Foreign Application Priority Data

Jan. 5, 2006 (TW) ..... 95100503 A

(51) Int. Cl.
*E05B 65/52* (2006.01)

(52) U.S. Cl. ..... 70/63; 70/158; 70/20; 70/52

(58) Field of Classification Search ..... 70/63, 70/20–22, 30–31, 33, 49, 51–53, 158, 159, 70/160, 163, 164; 220/676; 206/1.5, 308.2, 206/387.11, 317, 37.4, 37.7
See application file for complete search history.

(56) References Cited

U.S. PATENT DOCUMENTS

| | | | |
|---|---|---|---|
| 32,563 | A | 6/1861 | Hirschbuhl |
| 124,189 | A | 2/1872 | Zeiler |
| 371,796 | A | 10/1887 | Smith et al. |
| 410,024 | A | 8/1889 | Richards |
| 426,734 | A | 4/1890 | Mosley |
| 718,359 | A | 1/1903 | Koerber |
| 771,092 | A | 9/1904 | Ramey |

(Continued)

FOREIGN PATENT DOCUMENTS

| | | |
|---|---|---|
| DE | 14697 | 8/1881 |

(Continued)

OTHER PUBLICATIONS

"Combination Lock", available at http://buy-bags-online.efastmall.com/17330.htm, printed Mar. 1, 2005; 1 page.

(Continued)

*Primary Examiner*—Lloyd A Gall
*Assistant Examiner*—Kristina R Fulton
(74) *Attorney, Agent, or Firm*—Sheridan Ross P.C.

(57) ABSTRACT

A lockable container comprising a lock portion and a container is provided. The lock portion has a first part and a second part, wherein the first part has an opening component and at least a lock mechanism, the second part has at least a latch driven by the opening component. The container fits the second part. The container has at least an inner space and a wedge corresponding to the latch. The lock mechanism restricts a displacement of the opening component when the lock mechanism is locked. The lock mechanism releases the opening component when the lock mechanism is unlocked.

24 Claims, 15 Drawing Sheets

U.S. PATENT DOCUMENTS

| | | | |
|---|---|---|---|
| 883,571 | A | 3/1908 | Sahlsten |
| 941,028 | A | 11/1909 | Murphy |
| 972,171 | A | 10/1910 | Dupont |
| 999,044 | A | 7/1911 | Kuster |
| 1,001,104 | A | 8/1911 | Wayda |
| 1,025,538 | A | 5/1912 | Roche |
| 1,052,627 | A | 2/1913 | Takimoto |
| 1,155,405 | A | 10/1915 | D'Angelo |
| 1,161,158 | A | 11/1915 | Rennert |
| 1,326,394 | A | 12/1919 | Dowe |
| 1,384,390 | A | 7/1921 | Judycki |
| 1,597,560 | A | 8/1926 | Wise |
| 1,622,999 | A | 3/1927 | Firth |
| 1,667,254 | A | 4/1928 | Hedrich |
| 1,688,208 | A | 10/1928 | Rosso |
| 1,755,521 | A | 4/1930 | Smith |
| 1,816,951 | A | 8/1931 | Anez |
| 1,857,399 | A | 5/1932 | Piagneri |
| 1,897,922 | A | 2/1933 | Bradshaw |
| 1,937,523 | A | 12/1933 | Machinist |
| 1,981,163 | A | 11/1934 | Carlson |
| 2,001,262 | A | 5/1935 | North |
| 2,008,565 | A | 7/1935 | Segal |
| 2,049,416 | A | 8/1936 | Aldeen |
| 2,090,631 | A | 8/1937 | Junkunc |
| 2,110,094 | A | 3/1938 | Pauloski |
| 2,115,042 | A | 4/1938 | Olson |
| 2,159,291 | A | 5/1939 | Quintal |
| 2,163,852 | A | 6/1939 | Pond |
| 2,315,102 | A | 3/1943 | Adams |
| 2,357,305 | A | 9/1944 | Barrett |
| 2,378,768 | A | 6/1945 | Heyer |
| 2,487,608 | A | 11/1949 | Soref et al. |
| 2,497,619 | A | 2/1950 | Mass |
| 2,546,182 | A | 3/1951 | Fenari |
| 2,725,739 | A | 12/1955 | Check |
| 2,839,322 | A | 6/1958 | Kirk |
| 2,839,382 | A | 6/1958 | Graef |
| 2,923,928 | A | 2/1960 | McLaughlin |
| 2,926,514 | A | 3/1960 | Junkunc |
| 2,931,203 | A | 4/1960 | Check |
| 2,931,204 | A | 4/1960 | Check |
| 2,995,025 | A | 8/1961 | Toepfer |
| 3,009,345 | A | 11/1961 | Check |
| 3,050,977 | A | 8/1962 | Foote et al. |
| 3,349,584 | A | 10/1967 | Russell et al. |
| 3,408,839 | A | 11/1968 | Walters |
| 3,472,049 | A | 10/1969 | Sewell |
| 3,528,267 | A | 9/1970 | Orr |
| 3,546,906 | A | 12/1970 | Yang |
| 3,584,483 | A | 6/1971 | Orr |
| 3,702,551 | A | 11/1972 | Blizard |
| 3,720,082 | A | 3/1973 | Feinberg et al. |
| 3,729,962 | A | 5/1973 | Harrington et al. |
| 3,750,431 | A | 8/1973 | Atkinson |
| 3,808,848 | A | 5/1974 | Yang |
| 3,823,584 | A | 7/1974 | Gill |
| 3,824,819 | A | 7/1974 | Neary |
| 3,837,189 | A | 9/1974 | Atkinson |
| 3,894,415 | A | 7/1975 | Bako |
| 3,952,559 | A | 4/1976 | Atkinson |
| 4,055,972 | A | 11/1977 | Calegan |
| 4,170,884 | A | 10/1979 | Calegan |
| 4,325,240 | A | 4/1982 | Gable |
| 4,444,029 | A | 4/1984 | Remington |
| 4,453,390 | A | 6/1984 | Moritz et al. |
| 4,462,231 | A | 7/1984 | Zabel |
| 4,490,999 | A | 1/1985 | Castle et al. |
| 4,532,785 | A | 8/1985 | Uyeda |
| 4,559,796 | A | 12/1985 | De Forrest, Sr. |
| 4,576,022 | A * | 3/1986 | Gamble ..... 70/55 |
| 4,583,775 | A | 4/1986 | Bisbing |
| 4,609,780 | A | 9/1986 | Clark |
| 4,651,544 | A | 3/1987 | Hungerford |
| 4,683,738 | A | 8/1987 | Berkowitz |
| 4,730,467 | A | 3/1988 | Lebrecht |
| 4,733,548 | A | 3/1988 | Ling |
| 4,751,830 | A | 6/1988 | Cheng |
| 4,770,013 | A | 9/1988 | Nakai |
| 4,799,370 | A | 1/1989 | Cooper |
| 4,829,794 | A | 5/1989 | Crown |
| 4,829,795 | A | 5/1989 | Taylor |
| 4,851,652 | A | 7/1989 | Imran |
| 4,885,923 | A | 12/1989 | Nakai |
| 4,897,945 | A | 2/1990 | Webb |
| 4,901,057 | A | 2/1990 | Suneborn |
| 4,914,732 | A | 4/1990 | Henderson et al. |
| 4,961,330 | A | 10/1990 | Evans |
| 5,046,339 | A | 9/1991 | Krell |
| 5,082,169 | A | 1/1992 | Aurness et al. |
| 5,090,222 | A | 2/1992 | Imran |
| 5,117,661 | A | 6/1992 | Carl et al. |
| 5,125,248 | A | 6/1992 | Ling |
| 5,218,846 | A | 6/1993 | Cook et al. |
| 5,237,842 | A | 8/1993 | Rasch et al. |
| 5,327,752 | A | 7/1994 | Myers et al. |
| 5,381,685 | A | 1/1995 | Carl et al. |
| 5,400,629 | A | 3/1995 | Myers |
| 5,408,212 | A | 4/1995 | Meyers et al. |
| 5,428,369 | A | 6/1995 | Pranger et al. |
| 5,460,020 | A | 10/1995 | Hungerford |
| 5,493,878 | A | 2/1996 | Murray, Jr. et al. |
| 5,502,989 | A | 4/1996 | Enderlin et al. |
| 5,520,032 | A | 5/1996 | Ling |
| 5,525,964 | A | 6/1996 | Ming |
| 5,557,954 | A | 9/1996 | Ling |
| 5,574,480 | A | 11/1996 | Pranger et al. |
| 5,588,877 | A | 12/1996 | Davis et al. |
| 5,590,608 | A | 1/1997 | Yore et al. |
| 5,595,080 | A | 1/1997 | Whinton |
| 5,638,707 | A | 6/1997 | Gould |
| 5,642,131 | A | 6/1997 | Pekelney et al. |
| 5,715,709 | A | 2/1998 | Lai |
| 5,737,947 | A | 4/1998 | Ling |
| 5,746,075 | A | 5/1998 | Yang |
| 5,765,409 | A | 6/1998 | Yang |
| 5,791,172 | A | 8/1998 | Deighton et al. |
| 5,794,465 | A | 8/1998 | Hill |
| 5,794,466 | A | 8/1998 | Hungerford et al. |
| 5,829,285 | A | 11/1998 | Wilson |
| 5,868,012 | A | 2/1999 | Chun-Te et al. |
| 5,870,914 | A | 2/1999 | Dawson |
| 5,881,582 | A | 3/1999 | Monaco |
| 5,886,644 | A | 3/1999 | Keskin et al. |
| 5,911,764 | A | 6/1999 | Wei Kong |
| 5,983,679 | A | 11/1999 | Reyes |
| 6,000,251 | A | 12/1999 | Murray, Jr. et al. |
| 6,000,252 | A | 12/1999 | Murray, Jr. et al. |
| 6,029,481 | A | 2/2000 | Lai |
| 6,035,672 | A | 3/2000 | Lai |
| 6,047,575 | A | 4/2000 | Larson et al. |
| 6,047,577 | A | 4/2000 | Klimas |
| 6,070,442 | A | 6/2000 | Neeley et al. |
| 6,112,562 | A | 9/2000 | Murray, Jr. et al. |
| 6,137,472 | A | 10/2000 | Pekelney et al. |
| 6,146,181 | A | 11/2000 | Plaza |
| 6,147,622 | A | 11/2000 | Fonea |
| 6,155,088 | A | 12/2000 | Murray, Jr. et al. |
| 6,164,096 | A | 12/2000 | Lai |
| 6,192,719 | B1 | 2/2001 | Stukas et al. |
| 6,227,016 | B1 | 5/2001 | Yu |
| 6,315,485 | B1 | 11/2001 | Speck et al. |
| 6,317,313 | B1 | 11/2001 | Mosgrove et al. |
| 6,408,660 | B1 | 6/2002 | Lai |

6,434,980 B1 8/2002 Foster
6,449,992 B1 9/2002 Yu et al.
6,474,116 B1 11/2002 Lai
6,485,086 B2 11/2002 McGrath, Jr.
6,490,893 B1 12/2002 Benion
6,494,065 B2 12/2002 Babbitt, III
6,513,349 B1 * 2/2003 Miao ..... 70/57
6,513,356 B1 2/2003 Yang
6,516,643 B1 2/2003 Olshausen
6,526,786 B1 3/2003 Kayoda
6,539,761 B2 4/2003 Yang
6,553,794 B1 4/2003 Murray, Jr. et al.
6,553,795 B1 4/2003 Trempala
6,571,948 B2 6/2003 Jones
6,575,005 B1 6/2003 Hunter
6,588,241 B1 7/2003 Murray, Jr. et al.
6,598,434 B2 7/2003 Yang
6,615,626 B2 9/2003 Yu et al.
6,619,083 B2 9/2003 Hartel et al.
6,659,274 B2 * 12/2003 Enners ..... 206/305
6,675,614 B2 1/2004 Lai
6,679,088 B2 1/2004 Hartel et al.
D486,720 S 2/2004 Ling
6,708,532 B2 3/2004 Winland
6,708,534 B1 3/2004 Ruan
6,727,801 B1 4/2004 Gervasi et al.
6,729,166 B1 5/2004 Lai
6,732,664 B2 5/2004 Worrall
6,735,990 B1 5/2004 Murray, Jr. et al.
6,742,366 B1 6/2004 Lai
6,761,051 B1 7/2004 Tsai
6,792,778 B1 9/2004 Chen
6,799,445 B1 10/2004 Tsai
6,813,912 B1 * 11/2004 Ng et al. ..... 70/21
6,834,519 B1 12/2004 Yang
6,843,080 B1 1/2005 Yu
6,848,283 B1 2/2005 Lin
6,851,213 B1 2/2005 Doiron
6,860,125 B1 3/2005 Yu
6,877,345 B1 4/2005 Misner et al.
6,880,370 B2 4/2005 Yu
6,883,354 B1 4/2005 Yu
6,883,355 B2 4/2005 Lai
6,904,776 B1 6/2005 Lin
6,912,879 B1 7/2005 Yu
6,912,880 B2 7/2005 Ling et al.
6,926,544 B2 8/2005 Lee
6,928,842 B1 8/2005 Huang
6,937,140 B1 8/2005 Outslay et al.
6,938,445 B2 9/2005 Huang
6,997,023 B1 2/2006 Huang
7,003,988 B2 2/2006 Yu
7,007,520 B1 3/2006 Lin
7,007,521 B1 3/2006 Misner et al.
7,021,092 B2 4/2006 Loughlin et al.
7,021,537 B2 4/2006 Tropp
7,036,728 B2 5/2006 Tropp
7,047,772 B2 5/2006 Yu
7,086,258 B2 8/2006 Fisher et al.
7,100,401 B2 9/2006 Yu
7,100,403 B2 9/2006 Murray, Jr. et al.
7,100,404 B2 9/2006 Murray, Jr. et al.
7,104,092 B2 9/2006 Yu
7,111,479 B2 9/2006 Murray, Jr. et al.
7,114,356 B1 10/2006 Yu
7,248,904 B2 * 7/2007 Gartrell et al. ..... 455/575.8
7,305,858 B1 * 12/2007 Wu ..... 70/58
7,312,984 B2 * 12/2007 Richardson et al. .... 361/679.41
2002/0088256 A1 7/2002 Taylor et al.
2003/0101778 A1 6/2003 Carl et al.
2003/0196917 A1 * 10/2003 Broadhead ..... 206/308.2
2004/0074264 A1 * 4/2004 Kung et al. ..... 70/58
2004/0226324 A1 11/2004 Loughlin et al.
2004/0226325 A1 11/2004 Ling
2004/0246096 A1 12/2004 Queenan
2004/0255624 A1 12/2004 Loughlin et al.
2005/0034492 A1 2/2005 Yu
2005/0039500 A1 2/2005 Yu
2005/0039501 A1 2/2005 Yu
2005/0044901 A1 3/2005 Yu
2005/0044903 A1 3/2005 Ling et al.
2005/0127123 A1 6/2005 Smithers
2005/0150263 A1 7/2005 Murray, Jr. et al.
2005/0154605 A1 7/2005 Tropp
2005/0155397 A1 7/2005 Yu
2005/0210932 A1 9/2005 Azzalin et al.
2005/0223758 A1 * 10/2005 Yu ..... 70/63
2005/0226955 A1 10/2005 Yuasa et al.
2005/0229655 A1 10/2005 Yu
2005/0235705 A1 10/2005 Ling
2005/0235706 A1 10/2005 Ling
2005/0247584 A1 * 11/2005 Lu ..... 206/320
2005/0262902 A1 12/2005 Ling
2006/0107708 A1 5/2006 Yu
2006/0107709 A1 5/2006 Yu
2006/0130540 A1 6/2006 Lin
2006/0179899 A1 8/2006 Yu
2006/0225469 A1 10/2006 Yu
2006/0236731 A1 10/2006 Yu
2006/0243005 A1 11/2006 Lai et al.
2006/0254325 A1 11/2006 Yu
2006/0260369 A1 11/2006 Lai et al.
2006/0266084 A1 11/2006 Kuo et al.
2006/0272368 A1 12/2006 Yu
2007/0125141 A1 6/2007 Ling et al.
2007/0157679 A1 7/2007 Ling et al.
2007/0175248 A1 * 8/2007 Wu et al. ..... 70/58
2007/0180873 A1 8/2007 Yen

FOREIGN PATENT DOCUMENTS

DE 18176 12/1882
DE 41200 10/1887
DE 277587 8/1914
DE 509775 10/1930
DE 1553419 7/1970
DE 4140137 6/1993
DE 9319327 2/1994
DE 29611064 3/1998
DE 29814068 11/1998
DE 29823528 7/1999
DE 19937845 2/2001
DE 10049638 4/2002
DE 10122518 11/2002
EP 216823 4/1989
EP 1371797 12/2003
GB 588930 6/1947
GB 2191534 12/1987
GB 2312468 10/1997
JP 31007 4/1917
JP 6-3441 3/1931
JP 50-26793 3/1975
JP 55-78769 6/1980
JP 7-217293 8/1995
JP 7-217294 8/1995
TW 366943 8/1999
TW 482222 4/2002
TW 575046 2/2004
TW 590146 6/2004
TW 247654 10/2004
WO WO 2005/047626 5/2005

OTHER PUBLICATIONS

"Deluxe Vault Duo", available at http://buy-bags-online.efastmall.com/17340.htm, printed Mar. 1, 2005; 1 page.

"GE Security Access Point Stor-A-Key", General Electric Company 2004, 2 pages.

"Improving the Way Agents Sell Real Estate" GE Interlogix Supra, 2002, 7 pages.

"KeySafe Original" GE Infrastructure Security, available at http://www.geindustrial.com/ge-interlogix/solutions/consumer/keysafe_permanent.htm, printed Jan. 4, 2007, 2 pages.

"Locking Stor-A-Key" GE Infrastructure Security, available at http://www.geindustrial.com/ge-interlogix/solutions/consumer/storakey_locking.htm, printed Jan. 4, 2007, 1 page.

"Portable Stor-A-Key" GE Infrastructure Security, available at http://www.geindustrial.com/ge-interlogix/solutions/consumer/storakey_portable.htm, printed Jan. 4, 2007, 1 page.

Columbia Sportswear Company, "Adventure Gear" Fall 2003/Spring 2004 Catalog, copyright 2002, printed in the United States Nov. 2002, 4 pages.

"Columbia Lock" model No. C3440, shown in Columbia Sportswear Company, "Adventure Gear" Fall 2003/Spring 2004 Catalog, 3 pages.

"Columbia Lock" model No. C3442, shown in Columbia Sportswear Company, "Adventure Gear" Fall 2003/Spring 2004 Catalog, 3 pages.

"01844/5 Instructions" Blue Moon, date unknown, 1 page.

* cited by examiner

MULTI-PURPOSE DETACHABLE LOCK CONTAINER AND METHOD OF USE

CROSS REFERENCE TO RELATED APPLICATION

The present application is a continuation of U.S. patent application Ser. No. 11/620,368 filed Jan. 5, 2007 now abandoned, which claims priority under 35 U.S.C. §119 to Taiwanese Patent Application No. 095100503 filed on Jan. 5, 2006, both entitled "A Multi-Purpose Detachable Lock Container and Method of Use," and the contents of which are incorporated herein by reference in their entirety.

BACKGROUND OF THE INVENTION

1. Field of the Invention

The present invention generally relates to a lockable container, and more particularly, the present invention relates to a lockable container or box for securing articles deposited in the container or box and having a detachable lock for use in locking other articles other than the box or container.

2. Description of the Prior Art

Prior art lockable containers can be used, for example, to securely store keys in a location that is external to a house. In particular, the keys are placed inside a lockable container that is opened by means of a dial or combination lock. The box additionally contains a shackle that is unlocked by a separate means such as a key. The shackle is used to secure the lockable container to an object such as a door handle. A user can take out a key from the lockable container by opening the combination lock of the lockable container and then enter the house by using the key.

As can be appreciated, depositing keys in the lockable container is safer than hiding the keys under a mat, in a flowerpot, on a door frame or in some other obvious location. A typical prior art lock box is illustrated in FIG. 1*a* and FIG. 1*b*. Lock boxes such as these are made for a specific purpose and are not available for other purposes, nor do they come in a variety of shapes designed to specifically accommodate a variety of objects. Additionally, prior art lock boxes do not allow allow the lock box to be physically detached from the shackle portion while the shackle remains attached to an object, such as a door knob or handle.

Consumer electronics products such as mobile phones, MP3 players, digital cameras, flash disks and portable game players are popular and are getting lighter and smaller. It is common to carry one or more of these kinds of products at the same time. Notably, these products are high-priced and popular. Accordingly, they are likely to be stolen unless they are protected. Moreover, some of these products may store personal data. Besides the loss of the products themselves, losing these products may result in the loss of personal data that could lead to further problems.

Securing these products while simultaneously enjoying use of them is an important issue. Prior art lock boxes are not usable for securing consumer electronics or other personal item for several reasons. First, the lock boxes are not shaped appropriately to accommodate electronic devices or personal items. Second, the control panels of the electronic device cannot be accessed while the device is in the lock box. Third, prior art lock boxes are bulky and heavy because of their metal construction. Fourth, lock boxes are designed to attach to door knobs and similar fixed objects, not to a piece of clothing or other less sturdy and mobile personal items, such as back packs, purses, belts and the like. Accordingly, it would be advantageous to provide a lock box that is designed for and provides convenient access to electronic devices or other personal items and is light weight but nonetheless robust and secure.

SUMMARY OF THE INVENTION

The present invention is directed to a lockable container for securing consumer electronics or other valuable articles. Lockable containers of the present invention may be dustproof, waterproof, or shockproof. In accordance with embodiments of the present invention, various types of lockable containers are disclosed that incorporate various sizes of containers designed to accommodate various types of articles to be secured by end users.

The present invention is directed to a lockable container having a lock portion and a box or container. The lock portion has a first part and a second part. The first part of the lock portion has at least an opening component and a lock mechanism. The second part of the lock portion has at least a latch that is movable together with the opening component. A portion of the container fits over the second part. The container defines an inner space to retain an object or device and has a latch engaging member corresponding to the latch. The latch engaging member may be a wedge shaped body, a recessed portion, an aperture, or another latch-receiving member. When locked, the lock mechanism disables the opening component. In one embodiment, this is accomplished by restricting the displacement of an associated axis rod. When unlocked, the lock mechanism enables activation of the opening component. In one embodiment this is accomplished by allowing the displacement of the associated axis rod. When the lock mechanism is in an unlocked state, the container may be separated from the lock portion by pressing the opening component.

The lockable container of the present invention also includes an attaching device such as a cable, chain, or shackle that is used to connect the lock portion to an object or article of clothing. An end of the attaching device is released by a release mechanism that is disposed on the first part of the lock portion. In accordance with embodiments of the present invention, the release mechanism is covered by a portion of the container when the container is attached to the lock portion. Additionally, the release mechanism may be coupled to or associated with the opening component such that it is necessary to activate both in order release the attaching device. Accordingly, in such an embodiment, the attaching device can only be released if the lock mechanism is unlocked. This allows the lock portion itself to be usable for securing articles regardless of whether or not a container is attached. In particular, the attaching device may be threaded through a closed loop article that is to be secured, such as key chain, through or around an object to which the article is to be secured, such as a belt loop or fixed object, and then reattached to the lock portion. Alternatively, the lock portion may be used like a pad lock by threading the attaching device through a latch mechanism such as on the front of a locker.

The drawings are not necessarily to scale.

DETAILED DESCRIPTION

Figure 1A:
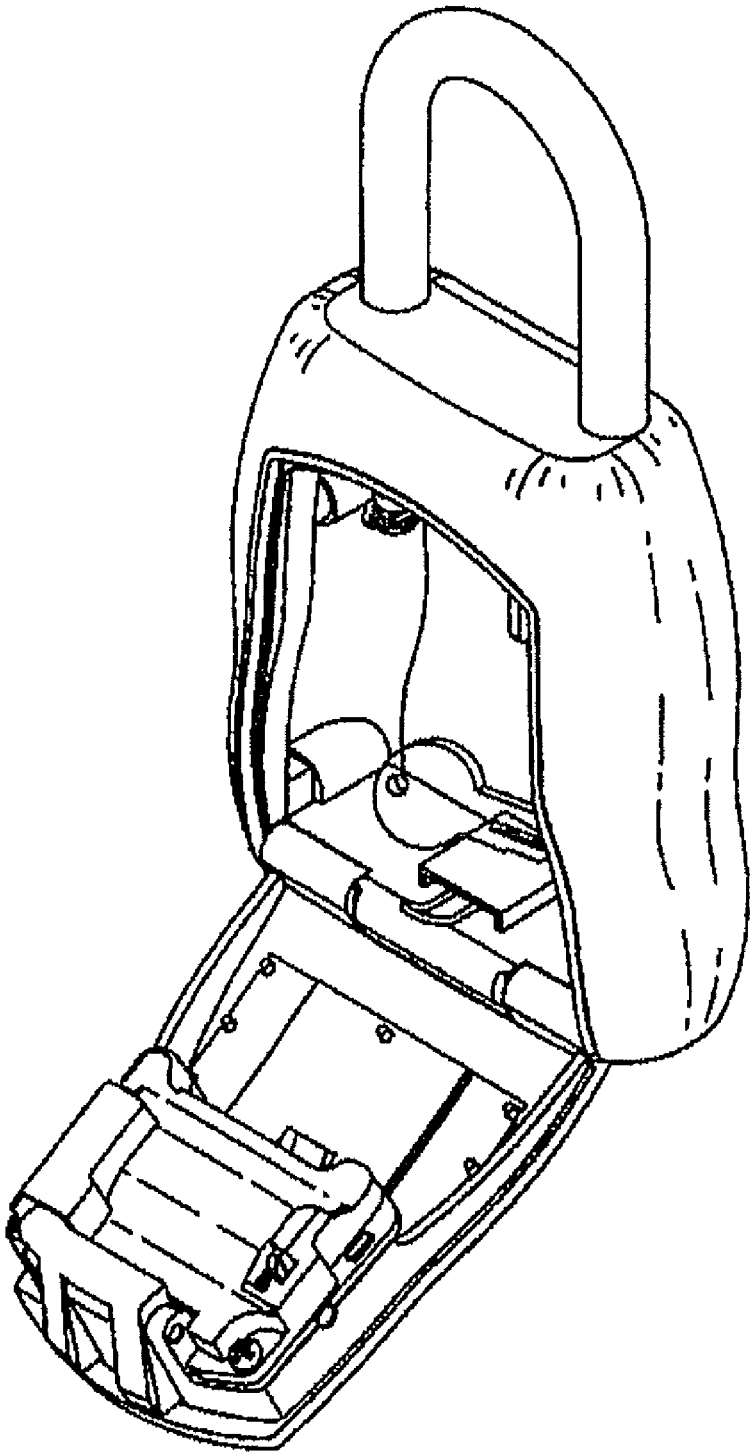
Fig. 1a (Prior Art)
FIG. 1*a* is a perspective view showing a lock box of the prior art.
Figure 1B:
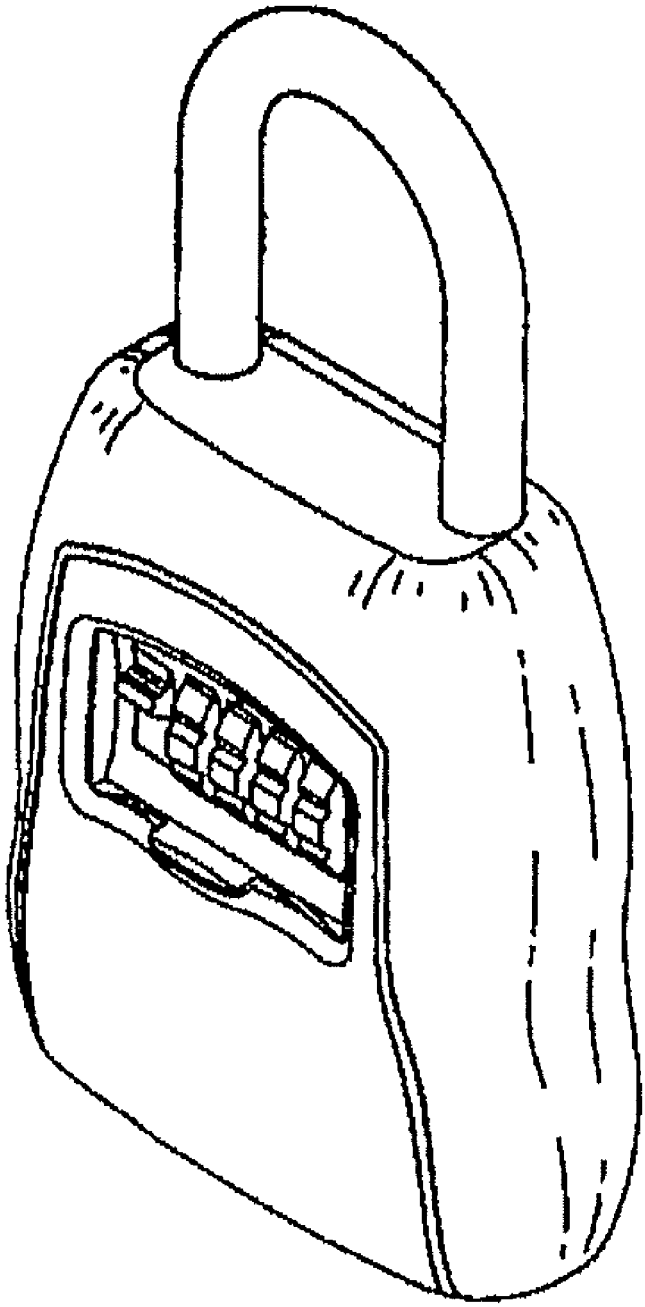
Fig. 1b (Prior Art)
FIG. 1*b* is another perspective view of the device shown in FIG. 1*a*, the device locked.
Figure 2:
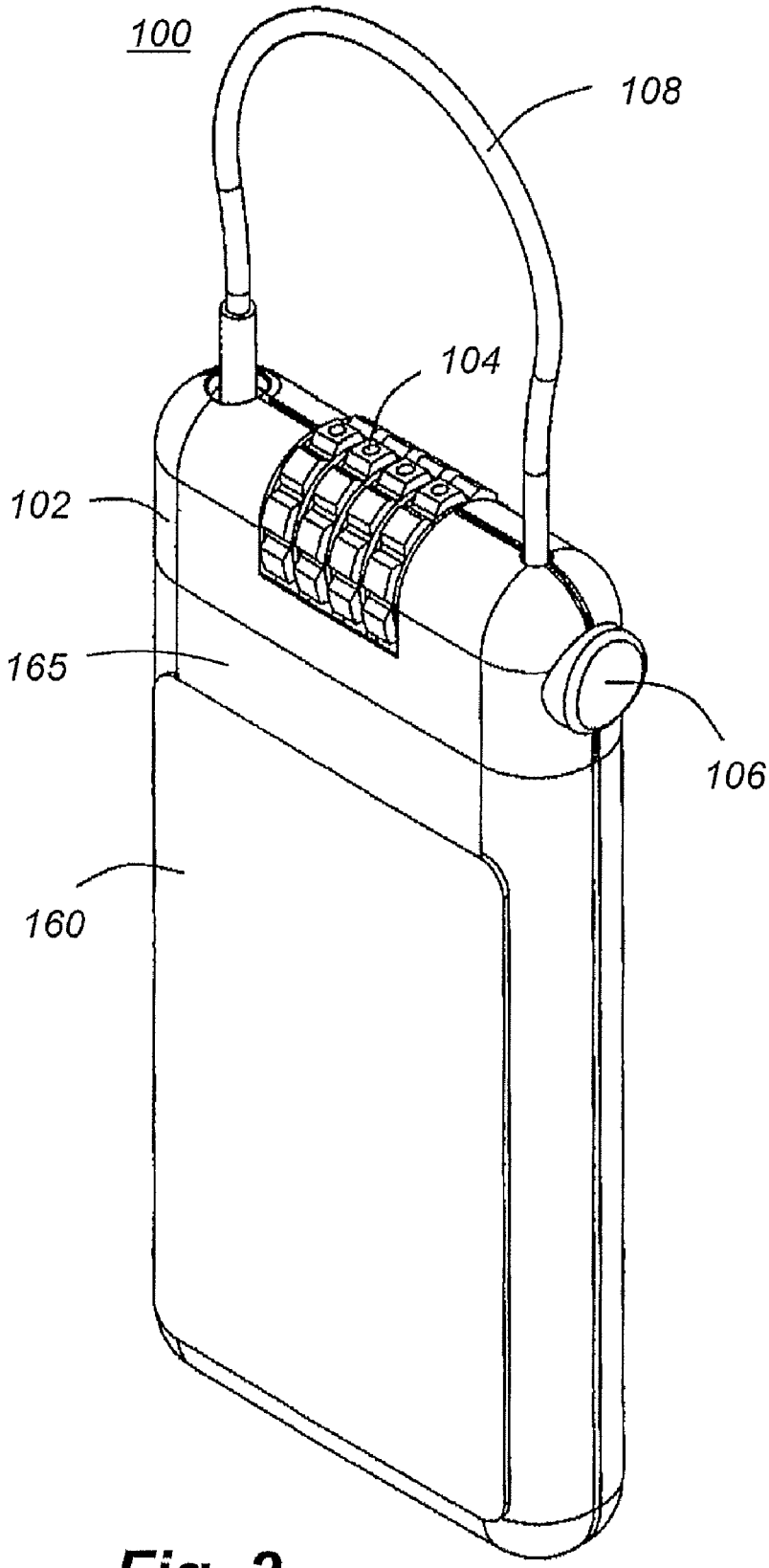
FIG. 2 is a perspective view of an embodiment of a lock box of the present invention.

Embodiments of the present invention are illustrated in FIGS. 2-12*b*. FIG. 2 and FIG. 3A show an embodiment of a lockable container 100 of the present invention. The lockable container 100 includes a lock portion 102 and a detachable container 160. In accordance with at least one embodiment of the present invention, the container can be physically detached from the lock portion 102. The lock portion 102 has a first part 1022 and a second part 1024. In this embodiment, when the lock portion 102 and the container 160 are attached, the first part 1022 and the outer surface 165 of the container 160 form a continuous surface. In this embodiment the container 160 surrounds and encloses the second part 1024. The first part 1022 has a lock mechanism or first actuation member 104 and an opening component 106. A latch 107 is disposed on at least one side of the second part 1024 and is driven by the opening component 106. Alternatively, two or more latches 107 may be employed, such as on opposite sides of the second part 1024.

Figure 3A:
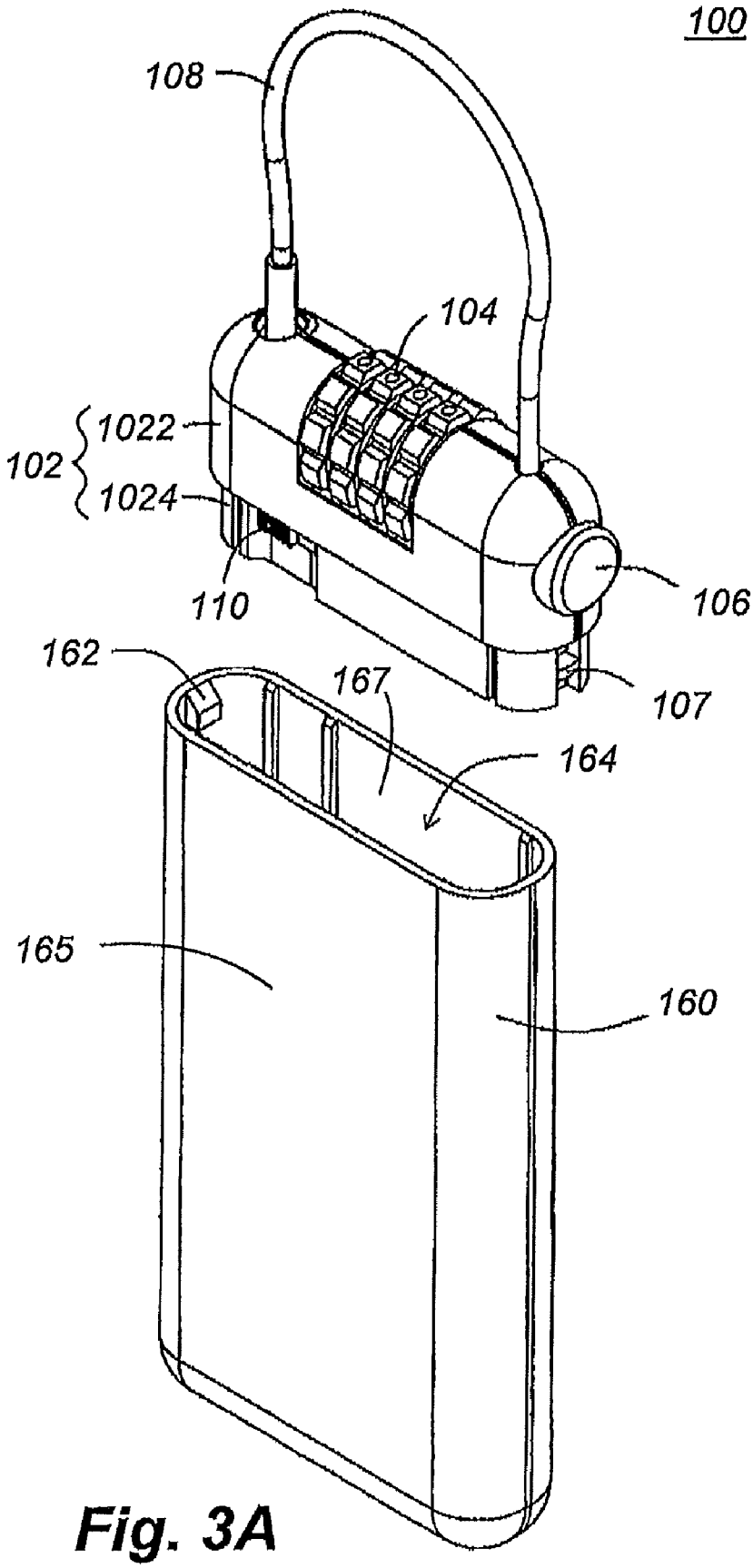
FIG. 3A is an exploded perspective view of the device shown in FIG. 2.
Figure 3B:
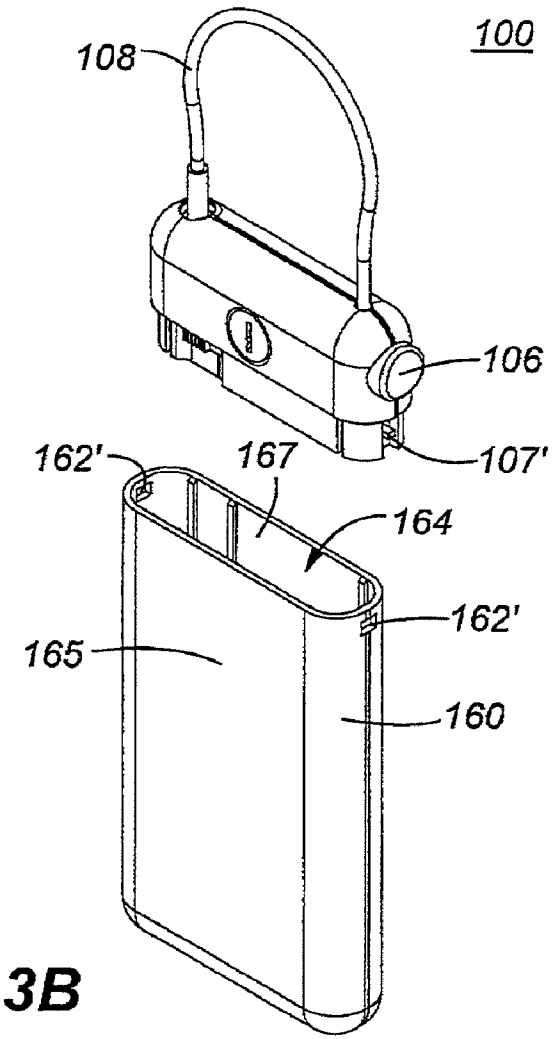
FIG. 3B is an exploded perspective view of an alternative embodiment.
Figure 3C:
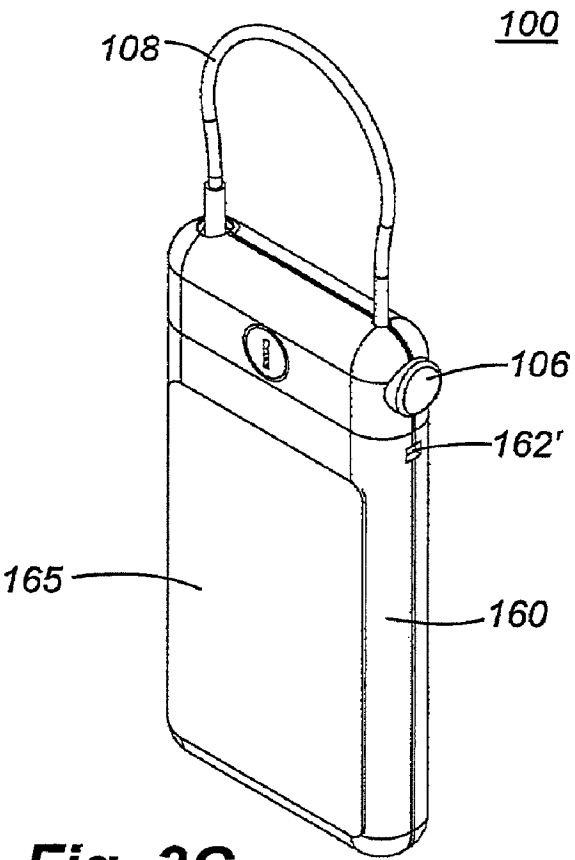
FIG. 3C is a perspective view of the embodiment of FIG. 3B.

The container 160 has an opening 167 and defines and inner space 164. At least one latch engaging member 162 is disposed proximate to the opening 167, wherein the latch 107 engages the latch engaging member 162 to secure the container 160 with lock portion 102. It will be appreciated that the latch engaging member 162 may also comprise an opening, notch or other type of catch that operatively cooperates with the latch 107. For example, FIGS. 3B and 3C illustrate an alternative embodiment where the latch 107' engages an aperture 162' in the container 160. Alternatively, the wedge or latch engaging member 162 is located in a recessed portion or portions of the container 160. Articles to be secured are passed through the opening 167 into the inner space 164. When locked, the lock mechanism 104 restricts a displacement of the opening component 106 preventing the lock portion 102 from detaching from the container 160. When unlocked, the lock mechanism 104 releases the opening component 106 allowing the lock portion 102 to separate from the container 160. The lock mechanism 104 in the present embodiment includes a combination lock, while in another embodiment, shown in FIGS. 3B and 3C, the lock mechanism 104' may comprise a key lock. Other embodiments of the present invention may include locking devices having alternative locking systems, including key pads, voice activated locks, fingerprint activated locks or bio-metric locks.

Figure 4:
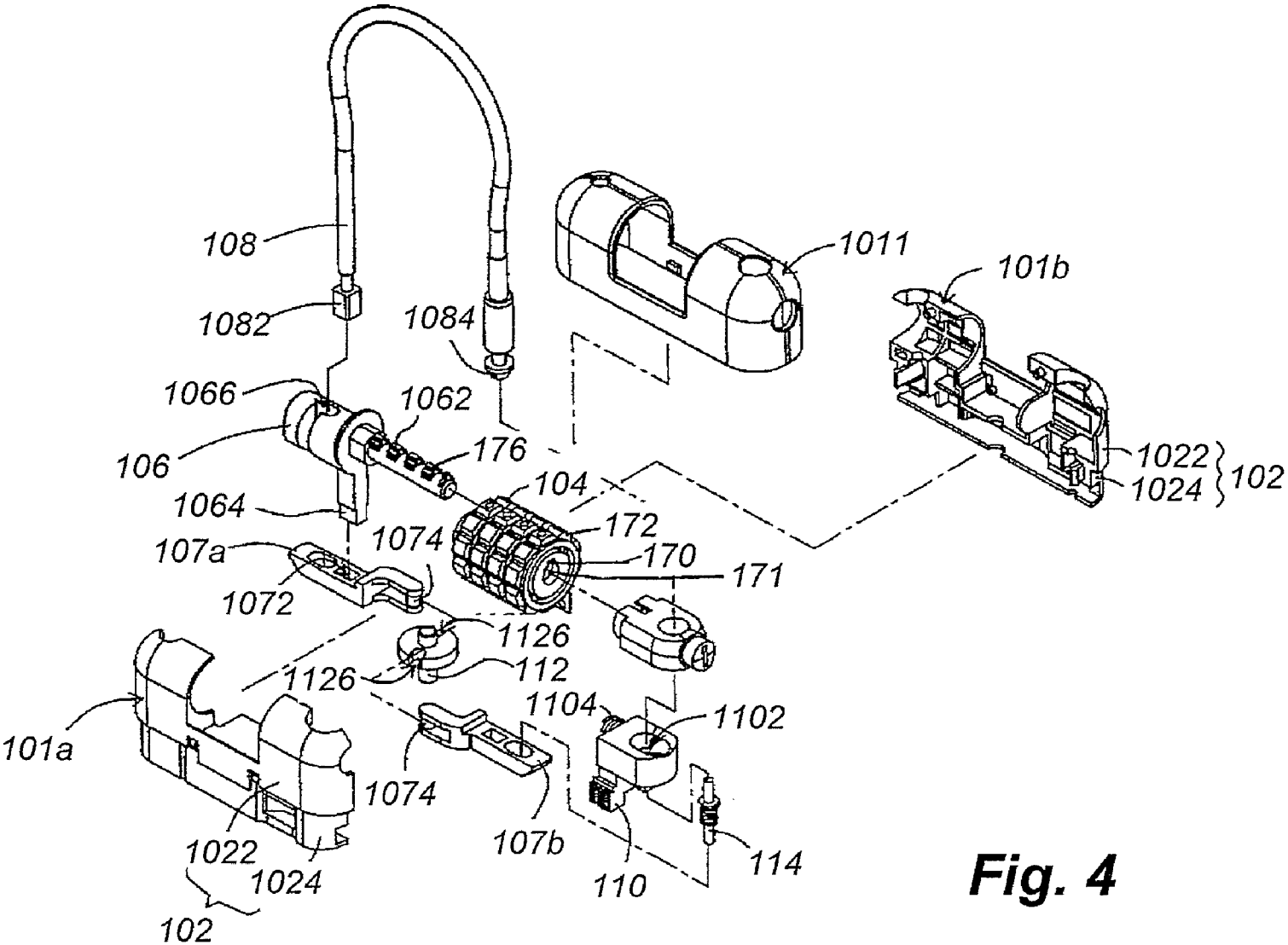
FIG. 4 is an exploded perspective view of the lock portion of the device shown in FIG. 3.

The lockable container 100 further comprises an attaching device 108 and a release mechanism or second actuation memeber 110. The attaching device 108 is disposed on the first part 1022 of the lock portion 102. In accordance with embodiments of the present invention, the attaching device 108 includes a flexible chain or cable. As FIG. 4 shows, the attaching device 108 has a first end 1082 and a second end 1084 when the attaching device 108 is a cable. The first end 1082 is fixed on the first part 1022 of the lock portion 102 while the second end 1084 is detachably attached to the first part 1022. In another embodiment, the attaching device 108 may be a rigid U-shaped shackle having a first end 1082 with a restricted displacement.

With reference to FIGS. 3 and 4, the release mechanism 110 is disposed on the second part 1024. The release mechanism 110 controls the second end 1084 of the attaching device 108 to either permit it to separate from or attach to the first part 1022. For manufacturing convenience, the lock portion 102 is composed of a housing that includes a first half shell 101*a* and a second half shell 101*b*. The first half shell 101*a* and the second half shell 101*b* preferably both include portions of the first part 1022 and the second part 1024. Further, an outer shell 1011 fits over and encloses at least a portion of the lock portion 102 to protect its inner components. The outer shell 1011 may be made of rubber, plastic or metal. In addition to providing structural strength, the outer shell 1011 may be used to provide aesthetics to the lockable container.

Figure 5A:
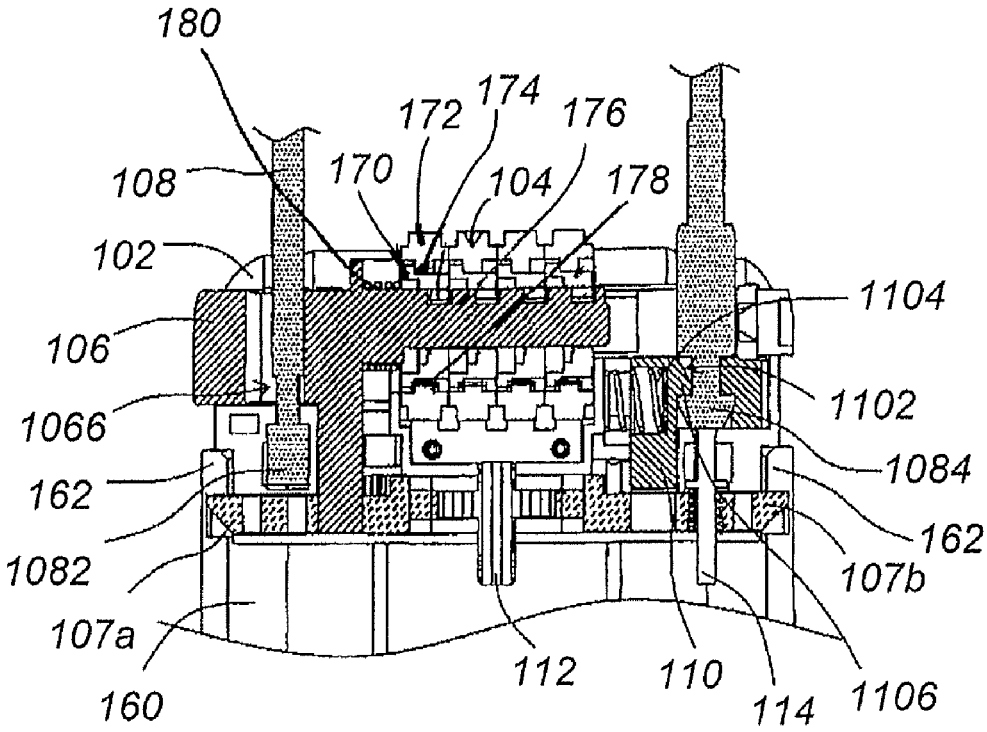
FIG. 5*a* is a cross-sectional view showing a locked state between the lock portion and the container.
Figure 5B:
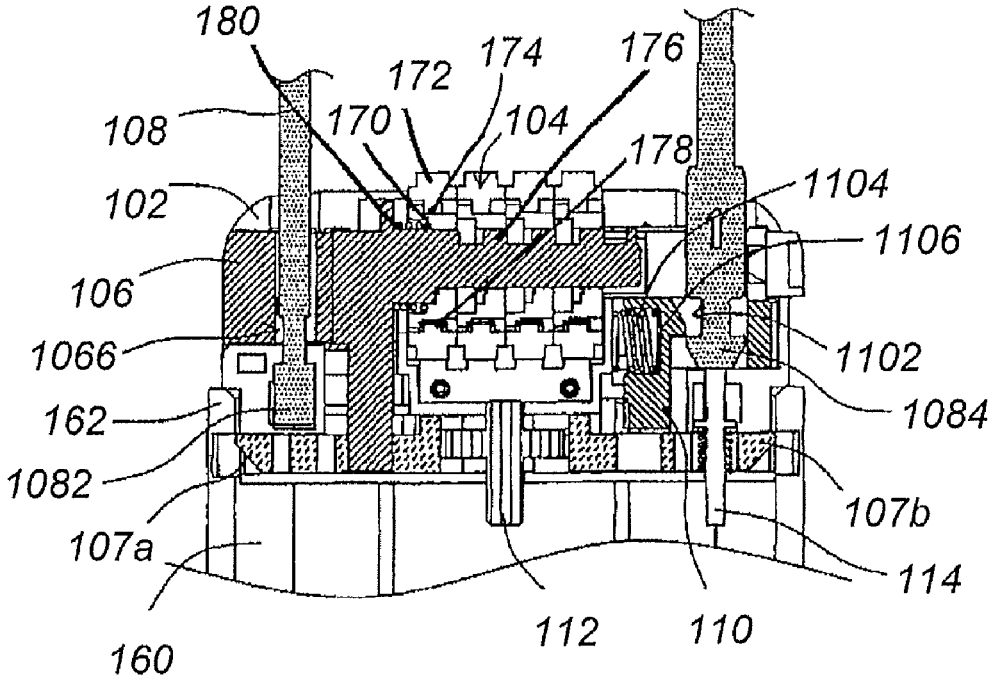
FIG. 5*b* is a cross-sectional view showing an unlock state of the lock portion.

In FIGS. 4, 5*a* and FIG. 5*b*, preferred operation steps of the lock mechanism 104 are illustrated. The opening component 106 has an axis rod 1062 and an extending rod 1064 oriented perpendicular to the axis rod 1062. The axis rod 1062 is disposed along and through the axis of the lock mechanism 104, while the extending rod 1064 passes through a hole 1072 of the latch 107*a*. When the lock mechanism 104 is locked, the axis rod 1062 is prevented from moving axially within the lock mechanism 104 and toward the side of the lock portion 102 opposite from the opening component 106. Conversely, when the lock mechanism 104 is unlocked, the axis rod 1062 is allowed to move axially within the lock mechanism 104 and towards the side of the lock portion 102 opposite from the opening component 106. The extending rod 1064 moves along with the axis rod 1062, which causes the latches 107*a* and 107*b* to move laterally, thereby disengaging themselves from the wedge or latching engaging member 162, as discussed in greater detail below.

The lock mechanism 104 may be a multiple-dial combination lock. As is known in the art, this type of lock may include a plurality of sleeves 170 each associated with one of a plurality of numbered dials 172. Each sleeve 170 has external teeth that engage internal teeth 174 disposed on a numbered dial 172. Each sleeve 170 includes a similarly shaped pattern 171 that corresponds to a pattern of notches 176 disposed on the axis rod 1062. When each of the sleeves 170 is rotated into a particular orientation, the sleeve patterns 171 (as best seen in FIG. 4) align with the notches 176 disposed on the axis rod 1062 allowing axial displacement of the axis rod 1062. More particularly, rotating the numbered dials 172 such that lock's 104 combination is displayed causes the sleeves 170 to be driven into the orientation that allows axial displacement of the axis rod 1062. In FIG. 5*a*, the sleeve patterns 171 and the axis rod notches 176 are not in alignment and, accordingly, the lock mechanism 104 is locked. In FIG. 5*b*, the sleeve patterns 171 and the axis rod notches 176 are aligned and, accordingly, the lock mechanism 104 is unlocked. The lock mechanism 104 additionally includes a leaf spring 178 to hold the numbered dials in place and a coil spring 180 to normally bias the axis rod 1062 in a locked position.

In a preferred embodiment, two latches 107*a* and 107*b* are disposed on opposite ends of the second part 1024 in a collinear arrangement. In another embodiment, however, the second part 1024 may have only one latch 107*a*. In yet another embodiment, two or more non-collinear latches 107*a* and 107*b* are disposed on opposite ends of the second part 1024. Furthermore, the latches 107*a* and 107*b* include rod portions 1074 in operative engagement with two concave receptacles 1126 of a projecting part 112. When unlocked, the lock mechanism 104 releases the axis rod 1064 allowing it to be axially displaced. When the opening component 106 is depressed, the axis rod 1062 and the extending rod 1064 (which passes through a hole 1072 in the latch as shown in FIG. 4) move inward at the same time. Inward movement of the extending rod 1064 causes an inward movement of one latch 107*a* which, in turn, causes the projecting part 112 to rotate. Simultaneously, the concave receptacles 1126 of the projecting part 112 drive the opposite latch 107*b* on the other side to move inward when the projecting part 112 rotates. Accordingly, when the opening component 106 is pressed down, the latches 107*a* and 107*b* inwardly move toward the interior of the lock portion 102 to release the lock portion 102 from the restriction of the wedge 162 of the container 160.

In accordance with embodiments of the present invention, the attaching device 108 is operatable when the container 160 is detached or separated from the lock portion 102. In at least one embodiment of the present invention, the release mechanism 110 disposed on the second part 1024 is operatable only when the release mechanism 110 is exposed. In an alternative embodiment (not shown), the release mechanism may be exposed when the container 160 is attached to the lock portion 102.

Components of the lock portion 102 associated with the operation of the attaching device 108 are illustrated in FIGS. 5*a* and 5*b*. In FIG. 5*a*, one side of the release mechanism 110 has an inverse angle socket 1102 to receive the second end 1084 of the attaching device 108. The release mechanism 110 slides laterally to release a spring 1104 to separate the second end 1084 from a hook 1106 of the release mechanism 110. A spring-loaded piston 114 is used to eject the second end 1084 of the attaching device 108 when it is released by a lateral movement of the release mechanism 110. The separated second end 1084 may penetrate, pass through or otherwise engage or secure an article, then connect back to the inverse angle socket 1102. As shown in FIG. 5*b*, the second end 1084 is coupled with the release mechanism 110, and released by exerting a force greater than that of the spring 1104. In a preferred embodiment, the first end 1082 is fixed in a penetration hole 1066 of the opening component 106.

Figure 6:
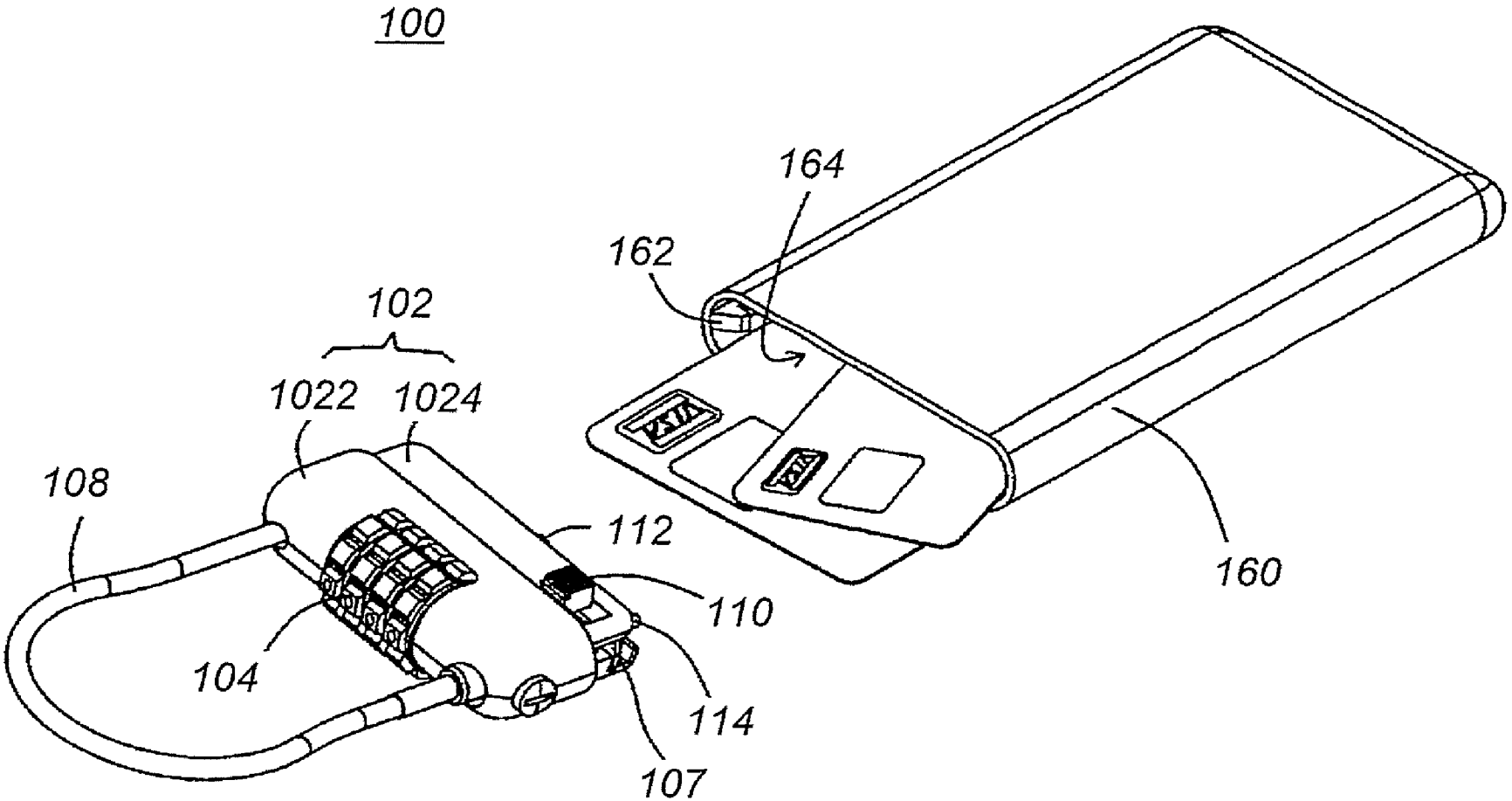
FIG. 6 is a schematic view of an embodiment of the present invention.
Figure 7:
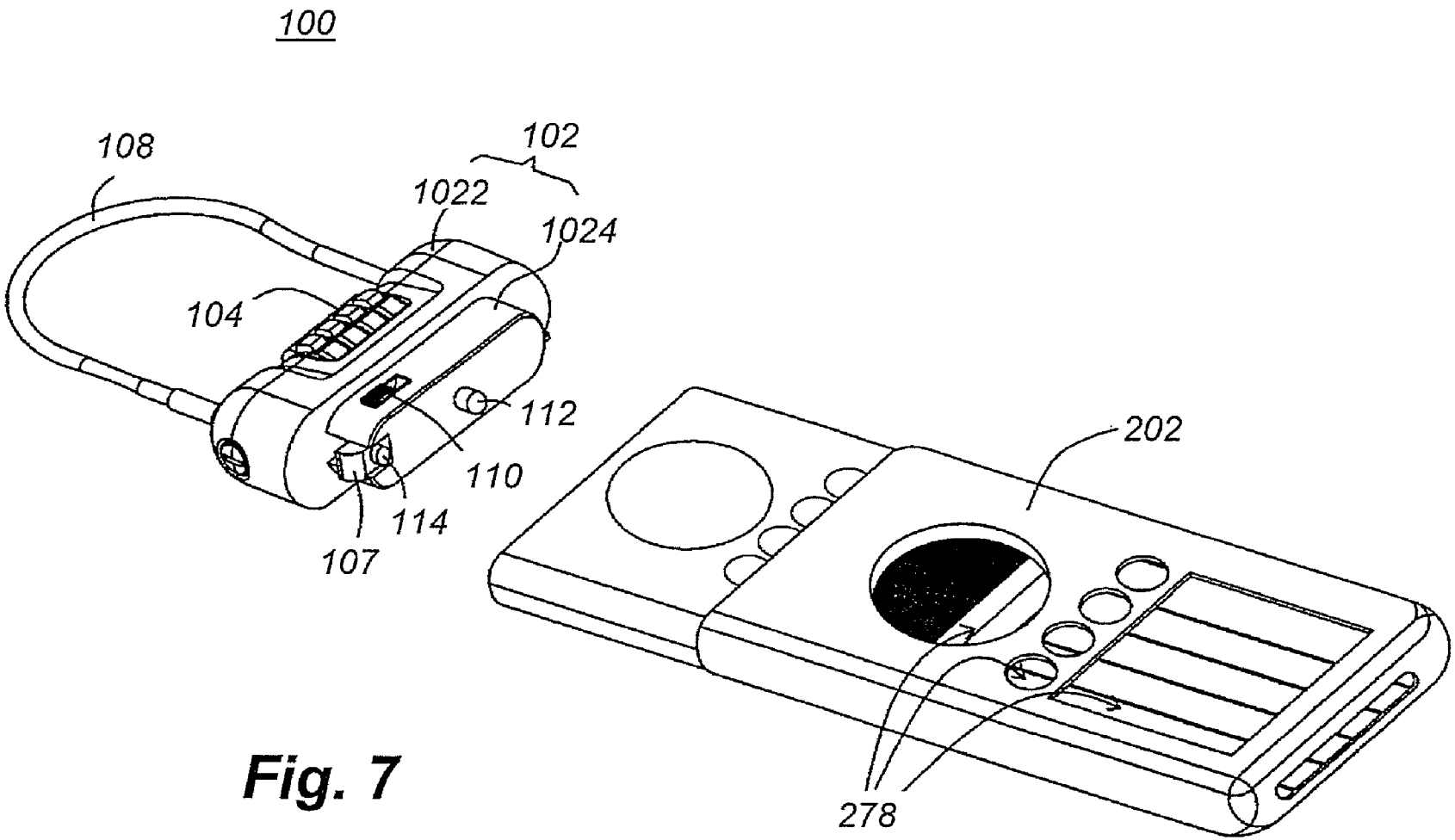
FIG. 7 is a schematic view of another embodiment of the present invention.

FIG. 6 and FIG. 7 illustrate the operation of a preferred embodiment. The lockable container 100 may include two containers 160 and 202 for receiving different articles. As noted above, and in accordance with one or more embodiments of the invention, the container can be physically detached from the lock portion 102. As shown in FIG. 6, the container 160 may be used to store precious articles such as wallets, and credit cards, keys, depending on size, and/or money. As shown in FIG. 7, the container 202 is used to contain particularly shaped electronic devices such as a MP3 player. Holes 278 are formed on the container 202 corresponding to the controlling panels of the MP3 player. Accordingly, the MP3 player can be operated and controlled via the holes 278 of the container 202 without taking the MP3 player out of the lockable container 202.

Figure 8:
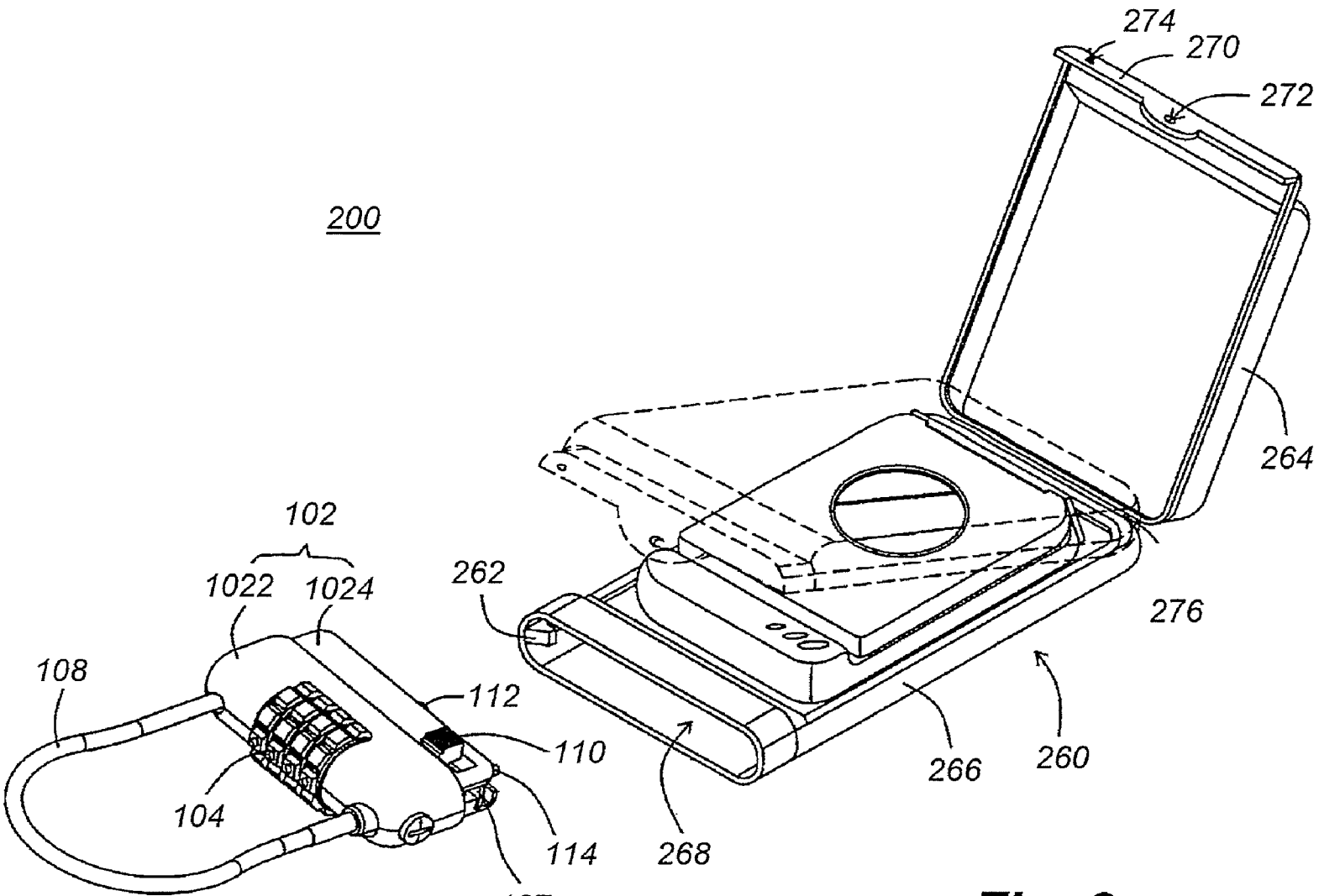
FIG. 8 is a schematic view of yet another embodiment of the present invention.

Another preferred embodiment is illustrated in FIG. 8. Except for the container 260, other components and operations are similar to the embodiments mentioned above. A cover 264 of the container 260 of this preferred embodiment is pivotally connected to a housing 266 by a pivot 276. The cover 264 of the container 260 in this preferred embodiment is therefore able to be opened or closed accordingly. Two latch engaging members 262 or cooperative apertures are disposed on the two sides of the opening of the housing 266 to engage the latch 107. The cover 264 and the housing 266 together form an inner space 268.

The cover 264 further includes an end side 270 having at least a hole or aperture 272. In a preferred embodiment, the end side 270 has a first hole 272 and a second hole or aperture 274. The first hole 272 and the second hole 274 are formed corresponding to the projecting part 112 of the second part 1024 and a portion of the spring loaded piston 114. When the lock portion 102 is engaged with the container 260, the projecting part 112 and a portion of the spring loaded piston 114 are disposed in the first hole 272 and the second hole 274 respectively to prevent the cover 264 from opening. Therefore, the cover 264 of the container 260 cannot be opened when the lock mechanism 104 is locked. On the other hand, the container 260 and the lock portion 102 are separable when the lock mechanism 104 is unlocked, and the cover 264 of the container 260 is able to be opened accordingly.

The external shape of the container 260 may be designed for a specific article to be contained in the inner space 268. For example, the external shape of the container 260 may be designed to store a mobile phone or other electronic or non-electronic devices in the inner space 268.

Figure 9:
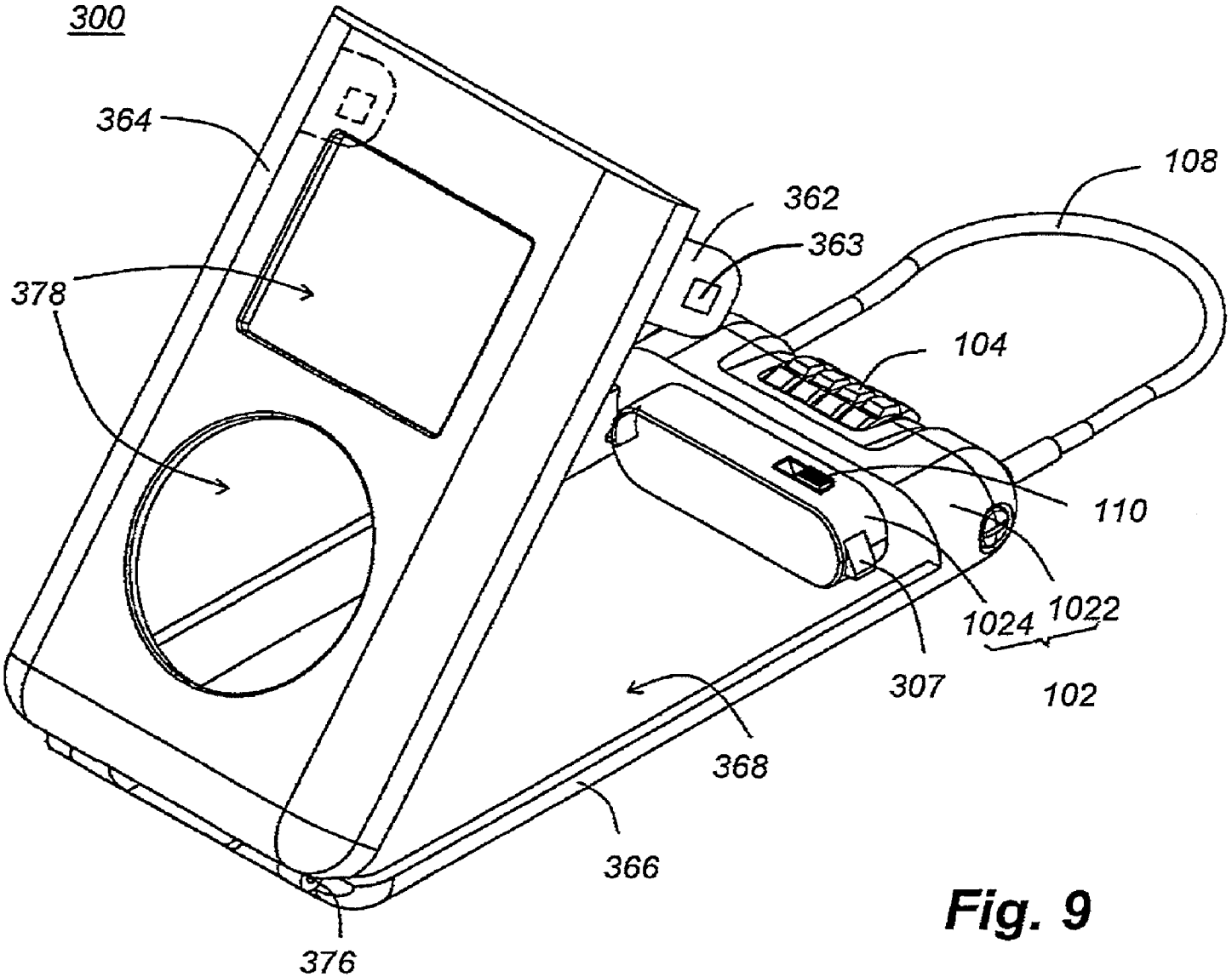
FIG. 9 is a schematic view of still yet another embodiment of the present invention.

Another preferred embodiment is illustrated in FIG. 9. The lock portion 102 and the housing 366 of the lockable container 300 of the preferred embodiment are integrally formed and therefore interconnected. The lockable container 300 includes a lock portion 102 and a cover 364. The lock portion 102 has a first part 1022, a second part 1024 and a housing 366. As better seen on the similar device depicted in FIG. 3, the first part 1022 has an opening component 106 and at least a lock mechanism 104. The second part 1024 has at least a latch 307 driven by the opening component 106. Referring again to FIG. 9, the housing 366 is an extension part of one side of the first part 1022, The cover 364 is pivotally connected to the housing 366 to form an inner space 368. The cover 364 has at least a latch engaging member 362 or cooperative aperture 363 corresponding to the latch 307. The lock mechanism 104 restricts the displacement of the opening component 106 when the lock mechanism 104 is locked and, as a result, the latch 307 remains laterally extended. Accordingly, when the lock mechanism 104 is locked, the cover 364 cannot be opened. When the lock mechanism 104 is unlocked, the lock mechanism 104 releases the opening component 106 allowing the latch 307 to displace laterally inward, thereby disengaging itself from the latch engaging mechanism 162. Therefore, the cover 364 is able to be opened when the opening component 106 is pressed. The operation of the attaching device 108 and the lock mechanism 104 are similar to the two embodiments mentioned above. The cover 364 is pivotally connected to the housing 366 by a pivot 376. Holes 378 are formed on the cover 364 corresponding to the controlling panel of the electronic devices including MP3 player, hand video game player, PDA or cellular phone.

Figure 10:
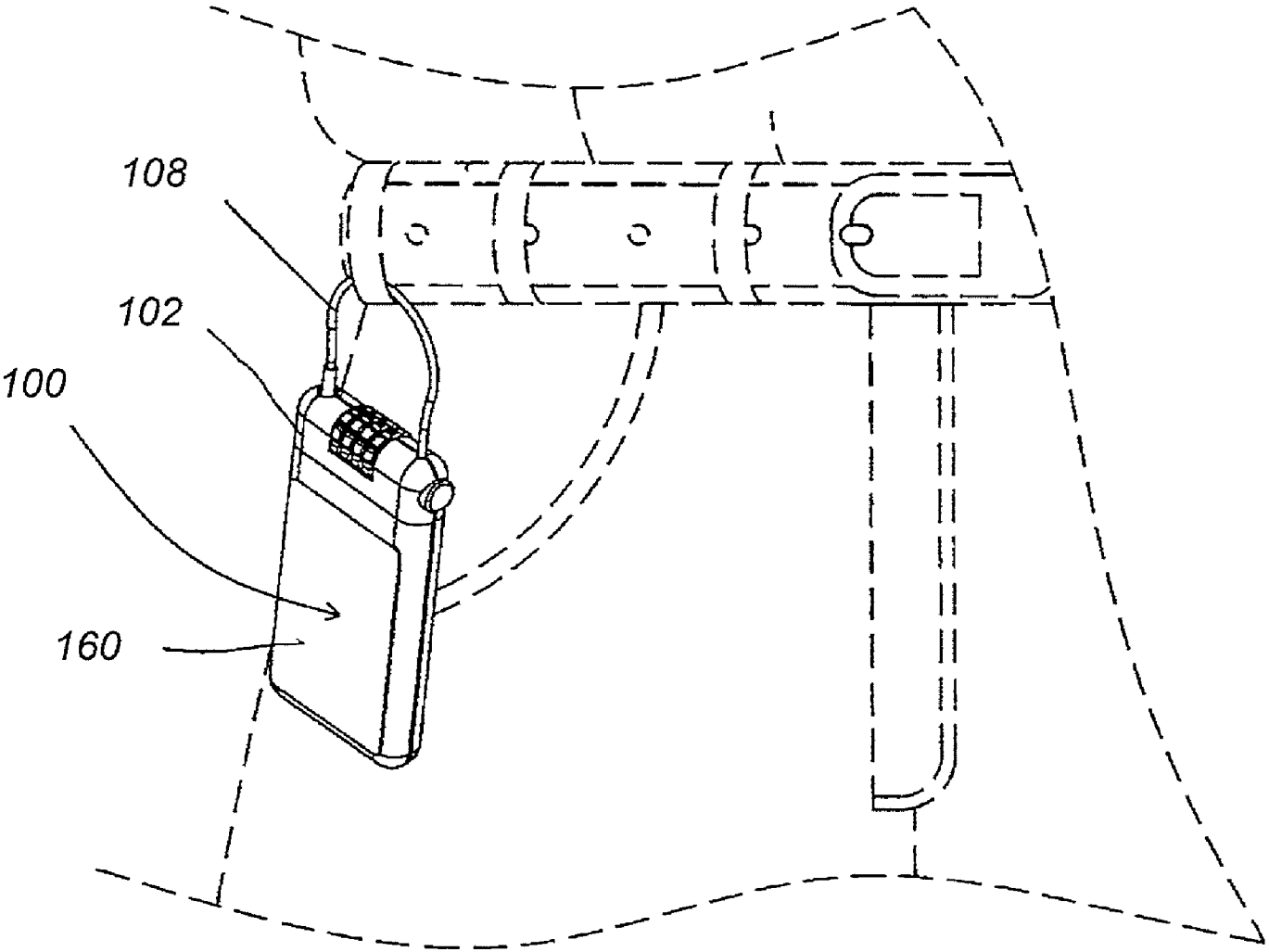
FIG. 10 is a schematic view showing operation of an embodiment of the lock container of the present invention.

In an embodiment shown in FIG. 10, the attaching device 108 is locked on a waist belt. The attaching device 108 may also be locked on a product or article, such as a chair, a desk, a backpack, purse, bike, scooter, locker or a closed loop door handle. Additionally, the container 160 may be dustproof or waterproof. Shockproof materials, such as sponge, plastic or rubber could be disposed in the inner space to resist shock an vibration.

Figure 11:
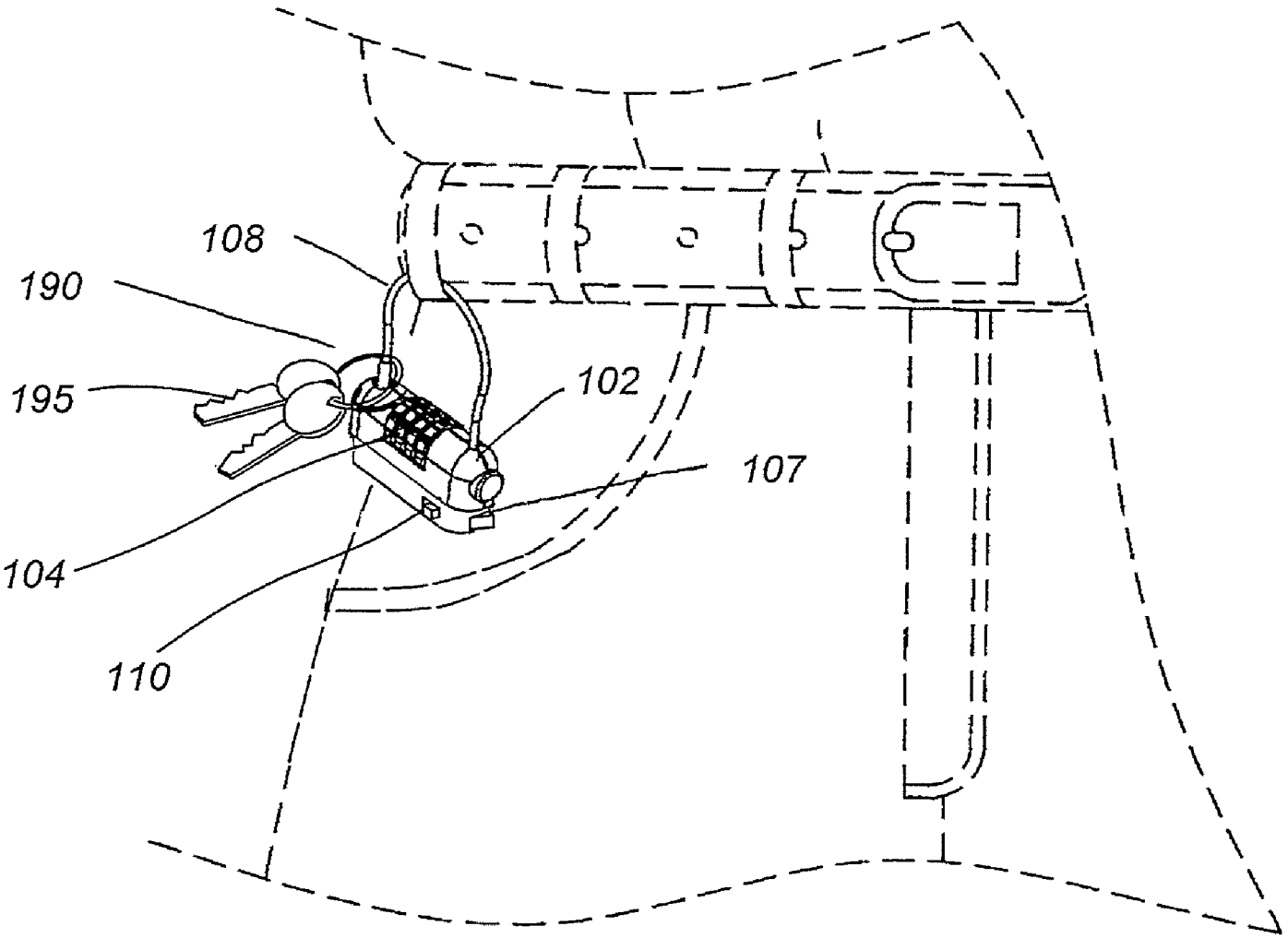
FIG. 11 is a schematic view showing an alternative operation of an embodiment of the lockable container of the present invention.

In an alternative embodiment shown in FIG. 11, the attaching component 108 itself is used to secure an article. Accordingly, the lock portion 102 may be used to secure an article regardless of whether or not it is attached to a container 160. In this capacity, the lock portion 102 may be used, for example, to secure keys or other items to a belt. For example, as shown in FIG. 11, the attaching device 108 is threaded through a key chain 190 used to contain a plurality of keys 195, through a belt loop, and then attached to the lock portion 102, as described above. If the lock portion 102 is used in this capacity, the item is secured by means of the attaching device 108 rather than being received by the container 160. Accordingly, it may be desirable to leave the container 160 unattached to the lock portion 102.

In accordance with embodiments of the present invention, structure may be provided for allowing the lock portion to be locked independent of a box or container. That is, a lock portion is provided that has separate utility independent of having a box or container. For such embodiments the second end of the attaching device is prevented from separating from its attachment to the lock portion when the lock mechanism is in a locked position. This allows articles attached by means of attaching component (as shown in FIG. 11) to remain securely locked regardless of whether or not a container is attached to the lock portion.

Figure 12A:
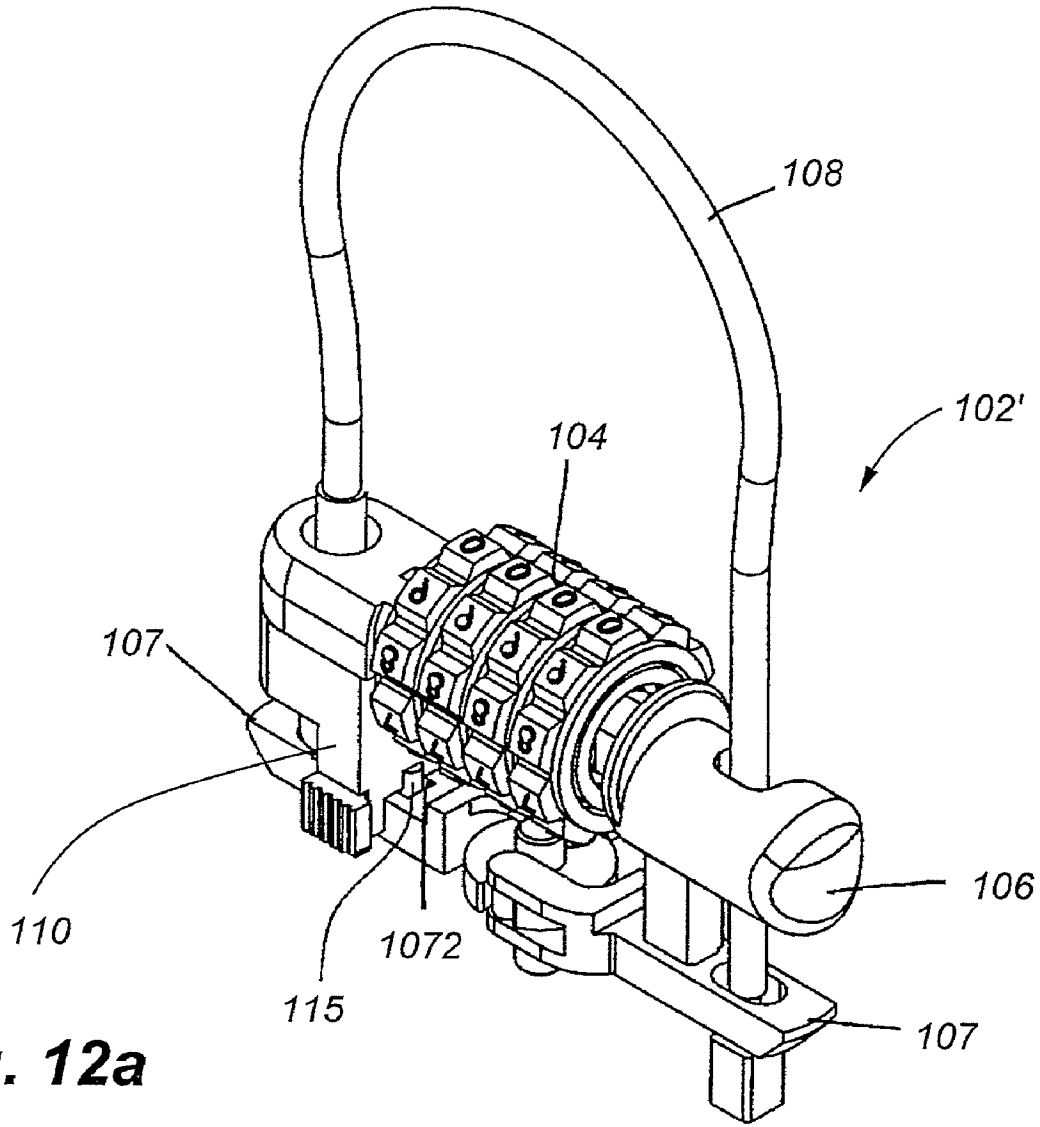
FIG. 12*a* is a perspective view showing a locked state of the lock portion of an embodiment of the present invention.
Figure 12B:
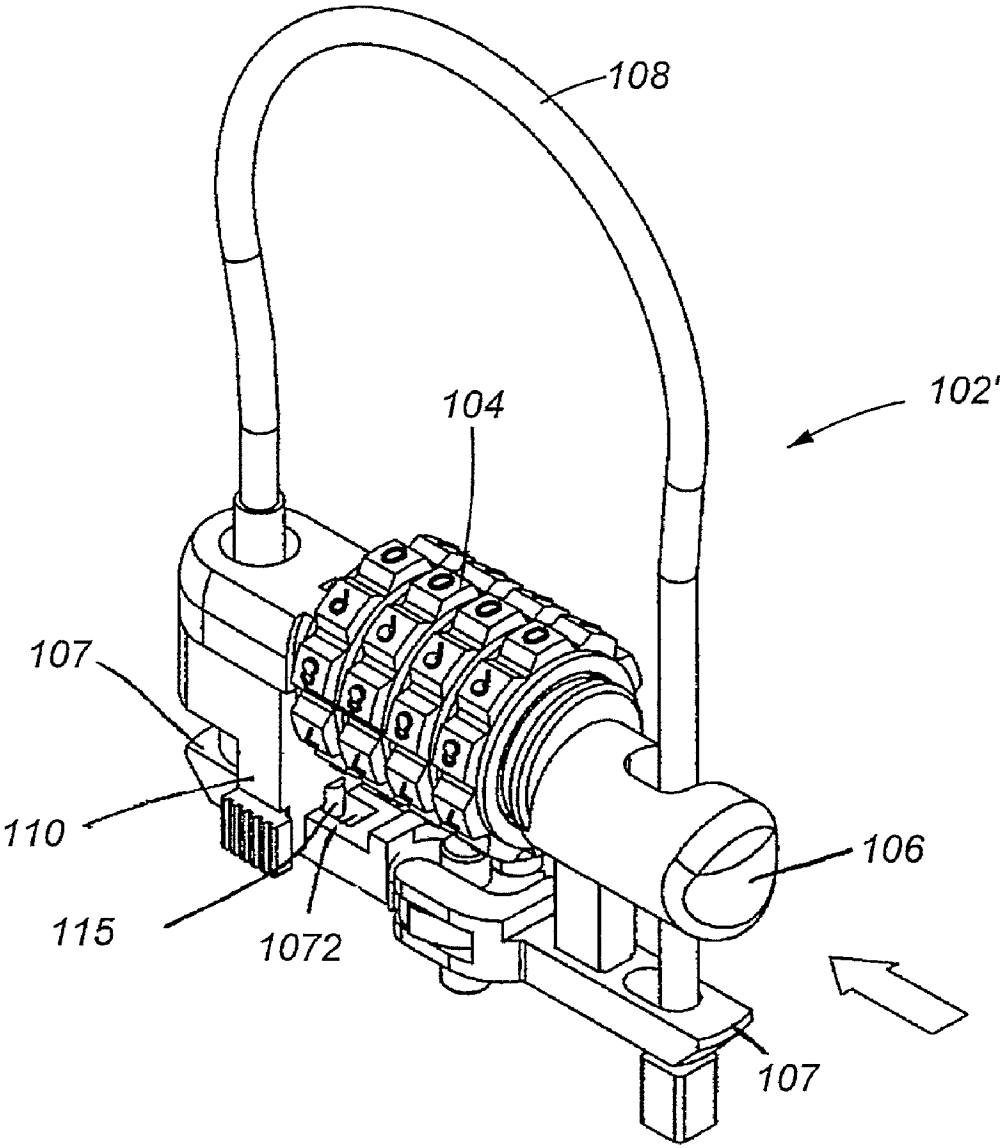
FIG. 12*b* is a perspective view showing an unlocked state of the lock portion of an embodiment of the present invention.

FIGS. 12*a* and 12*b* illustrate components of the lock mechanism 102 that operate to prevent the attaching device 108 from separating from the lock portion 102 when the lock mechanism 104 is in a locked position. The release mechanism 110 includes a blocker portion 115 that fits within a hole 1072 of the latch 107. In FIG. 12*a*, the opening component 106 is not depressed and as a result, the latches 107 remain outwardly displaced. In this position, the blocker 115 is pressed against the side of the hole 1072. Accordingly, the attaching controlling component 110 is prevented from moving inward to release the attaching device 108. In FIG. 12*b*, the opening component 106 is depressed, and as a result, the latches 107 are displaced inwardly. In this position, a space exists between the blocker 115 and the wall of the hole 1072. As a result, the attaching controlling component 110 is allowed to move inwardly to release the attaching device 108.

As can be seen in FIGS. 12*a* and 12*b*, and in accordance with embodiments of the present invention, releasing the attaching device 108 involves two actions. First, the opening component 106 is depressed to move the latches 107 inward, and second, the attaching controlling component 110 is moved inward. If the lock mechanism 104 is locked, pressing the opening component 106 down will not move the latches 107 inward. As a result, the release mechanism 110 is prevented from moving inward to release the attaching device 108. If the lock mechanism 104 is unlocked, depressing the opening component will move the latches 107 inward. As a result, the release mechanism is allowed to move inward to release the attaching device 108.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims. For example, various cooperating locking mechanisms are described herein, including latch 107 and latch engaging member 162, latch 107 and latch engaging members 262, projecting part 112 and first aperture 272, piston 114 and aperture 274, and latch 307 and latch engaging member 362. It will be appreciated by those of skill in the art that the configurations of these locking mechanisms may vary, including where the latch components are protruding members and the engaging members are openings or cooperative catches, or alternatively where the latches are openings or catches and the latch engaging members and apertures are protruding members. The important aspect is that the separate component pieces may be secured to each other and not the structure of the locking mechanism.

The present invention, in various embodiments, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, e.g., for improving performance, achieving ease and\or reducing cost of implementation.

The foregoing discussion of the invention has been presented for purposes of illustration and description. The foregoing is not intended to limit Invention to the form or forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Moreover, though the description of the invention has included description of one or more embodiments and certain variations and modifications, other variations and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A lockable container, adapted to secure at least one article, comprising:

a container for carrying at least one article, the container comprising a plurality of walls and an engaging member, wherein the plurality of walls inhibit movement of the article in every direction except one while the article is held by the container; and a locking member adapted for engagement with the engaging member, wherein in an engaged position the locking member is secured to the engaging member and prevents removal of the article from the carrier, and in a disengaged position the locking member is disengageable from the engaging member, allowing the locking member to be completely disengaged from the container and the article to be positioned in or removed from the container;

the locking member comprising an attachment member to lockably engage the locking member to an object while the locking member is engaged with the container to secure the container and the locking member to the object;

the locking member further comprising a first release mechanism which must be actuated to disengage the engaging member and a second release mechanism which must be actuated to disengage the attachment member, the second release mechanism not being actuatable by a user when the container is secured to the locking member.

2. The lockable container of claim 1, wherein the attaching device includes a shackle.

3. The lockable container of claim 1, wherein the locking member includes a combination lock.

4. The lockable container of claim 1, wherein the locking member includes a key lock.

5. The lockable container of claim 1, wherein the plurality of walls substantially prohibits movement of the article relative to the container in all directions except one.

6. The lockable container of claim 1, wherein the plurality of walls inhibits movement of the article in five directions.

7. The lockable container of claim 1, wherein the plurality of walls comprises two walls disposed parallel to a first plane and three walls disposed orthogonally to the first plane.

8. The lockable container of claim 1, further comprising at least one opening in the container wherein when an article is held by the container the article is accessible while the locking member prevents removal of the article from the container.

9. The lockable container of claim 1, wherein the locking member comprises a latch and the engaging member comprises a latch engaging member.

10. The lockable container of claim 1, wherein the engaging member comprises an aperture.

11. A device adapted to secure at least one article having operative controls, comprising:

a container for holding at least one article, the container comprising a plurality of walls, wherein the plurality of walls inhibit movement of the at least one article in every direction except one while the at least one article is held by the container and the plurality of walls includes at least one opening;

a lock adapted for engagement with the container, wherein in an engaged position the lock is secured to the container and prevents removal of the at least one article from the container, and in a disengaged position the lock is fully disengageable from the container, allowing the at least one article to be positioned in or removed from the container;

the lock comprising an attachment member adapted to lockably engage the lock to an object while the lock is engaged with the container to secure the container and the lock to the object;

the lock further comprising a first release mechanism which must be actuated to disengage the lock from the container and a second release mechanism which must be actuated to disengage the attachment member, the first and second release mechanisms being independently actuated.

12. A device for securing an article, the article having manually operated controls, comprising:

means for holding the article and for inhibiting movement of the article in every direction except one;

access means for accessing the controls of the article;

lock means for securing the article in the means for holding the article, the lock means adapted for locking engagement with the means for holding the article, wherein in a first position the lock means is secured to the means for holding the article and prevents removal of the article from the means for holding the article, and in a second position the lock means is completely separable from the means for holding the article, allowing the article to be positioned in or removed from the means for holding the article;

said lock means comprising an attachment means adapted to lockably engage the lock means to an object while the lock means is secured to the means for holding the article to secure the means for holding the article and the lock means to the object, a first release means to disengage the lock means from the means for holding and a second release means to disengage at least a portion of the attachment means from the lock means, the first and second release means being independently actuatable.

13. The device of claim 12, wherein said means for holding an article comprises a plurality of walls.

14. The device of claim 13, wherein said plurality of walls define an open space and said open space comprises said access means.

15. The device of claim 14, wherein said access means comprises a hole in at least one wall.

16. The device of claim 12, wherein said lock means may secure one object to another object independent of said means for holding an article.

17. The device of claim 12, wherein said attachment means comprises a shackle.

18. The device of claim 12, wherein said lock means comprises a combination lock mechanism.

19. The device of claim 12, wherein said lock means comprises a key actuated lock mechanism.

20. The device for securing an article of claim 12, wherein the second release means is not accessible by a user when the lock means and the means for holding an article are lockingly engaged.

21. The lockable container of claim 1, wherein the first release mechanism and the second release mechanism are independently actuated.

22. A multipurpose security device, comprising:

a. a lock portion comprising a first part, a second part and a locking mechanism, the locking mechanism having a locked state and an unlocked state, the first part comprising a first activation member accessible on the exterior of the first part and enabled when the locking mechanism is in an unlocked state and not enabled when the locking mechanism is in a locked state, the second part comprising a first engaging member movable by operation of the first activation member, and a second activation member actuateable when the locking member is in an unlocked state;

b. an attaching device comprising a first end and a second end each connected to said lock portion and at least one of which is detachably connected to the lock portion;

c. a container adapted to connect to and physically detach from the lock portion, the container comprising an opening to receive the second part of the lock portion and a second engaging member which interacts with the first engaging member to secure the container to the lock portion, said container having an inner space to receive and hold objects, the inner space being accessible through the opening in the container; and d. the second activation member operatively associated with at least one of said first and second end of said attaching device to release the at least one of the first and second end of the attaching device when actuated and the second activation member accessible by the user only when the container is detached from the lock portion;

e. wherein actuation of the first activation member allows the container to be physically detached from said lock portion.

23. The multipurpose security device of claim 22, wherein said second activation member is interconnected with said locking mechanism, and wherein said second activation member is disabled and said at least one of said first end and second end is not detachable from said first part when said locking mechanism is in said locked state, and when said locking mechanism is in said unlocked state said second activation mechanism is enabled and said at least one of said first end and second end is detachable from said first part by activating said second activation mechanism.

24. The multipurpose security device of claim 22, wherein the container is shaped to hold an electronic device and the container includes at least one aperture to access one or more controls of the electronic device when the container is attached to the lock portion.

* * * * *